US007475867B1

(12) United States Patent
Romo

(10) Patent No.: US 7,475,867 B1
(45) Date of Patent: Jan. 13, 2009

(54) FAIRLEADS FOR BUILDING PLATFORMS

(75) Inventor: David Arevalo Romo, Bonney Lake, WA (US)

(73) Assignee: SafeWorks, LLC, Tukwila, WA (US)

( * ) Notice: Subject to any disclaimer, the term of this patent is extended or adjusted under 35 U.S.C. 154(b) by 0 days.

(21) Appl. No.: 11/851,975

(22) Filed: Sep. 7, 2007

(51) Int. Cl.
*B66D 3/00* (2006.01)

(52) U.S. Cl. ..... 254/383; 242/157 R

(58) Field of Classification Search ..... 254/323, 254/385, 333, 334, 383; 242/157 R
See application file for complete search history.

(56) References Cited

U.S. PATENT DOCUMENTS 4,311,109 A 1/1982 Webb ..... 114/220
4,742,993 A * 5/1988 Montgomery et al. ..... 254/389
5,072,962 A * 12/1991 Webb ..... 280/414.1
5,634,628 A * 6/1997 Schuch ..... 254/331
6,371,449 B1 * 4/2002 Chamberlain ..... 254/387
6,401,370 B1 6/2002 Blom et al. ..... 37/396
6,631,886 B1 * 10/2003 Caudle et al. ..... 254/327
6,722,303 B2 4/2004 Lob et al. ..... 114/218
6,910,679 B1 * 6/2005 Vogt et al. ..... 254/385
7,290,755 B1 * 11/2007 Thibodeaux ..... 254/323

* cited by examiner

*Primary Examiner*—Emmanuel M Marcelo
(74) *Attorney, Agent, or Firm*—Woodcock Washburn LLP

(57) ABSTRACT

In various embodiments, an apparatus is disclosed comprising a platform, a hoisting machine mounted on the platform, and a rigging operable to raise and lower the elevator platform, said rigging passing through a fairlead, said fair lead stabilizing said elevator platform to a single location proximate a top of said elevator platform, said fairlead comprising two separable parts wherein said separable parts can be placed around said rigging without accessing an end of said rigging. Such a fairlead improves the serviceability of the equipment and reduce down time for replacement of a worn or damaged fairlead.

38 Claims, 5 Drawing Sheets

FAIRLEADS FOR BUILDING PLATFORMS

BACKGROUND

A fairlead is a device such as a ring or a block that has a guide opening, typically used to guide a rigging such as a line, rope or cable around an object, or to stop the rigging from moving laterally. The American Society of Mechanical Engineers (ASME) defines a fairlead as "the uppermost guide for the suspension wire rope." Such a device is useful to hold lines, ropes or cables in place or prevent a rigging from snagging. A fairlead can also be used to stop a straight run of line from vibrating or rubbing on another surface. The fairlead may be a separate piece of hardware, or it could be integral with another structure.

Fairleads are used in a variety of applications in which riggings are used, including marine vehicles, loading devices, and various hoisting applications such as elevated platforms for building maintenance. In a hoisting application, an elevated platform or basket is typically raised or lowered using a powered hoisting device attached to the platform. The hoisting device utilizes a cable that is guided through a fairlead that stabilizes the lateral movement of the cable, thus stabilizing movement of the platform as well as preventing the cable from snagging.

Fairleads typically wear over time from the continuous movement and friction of the rigging against the inner edges of the fairlead, and will eventually require replacement or repair. Generally, when the fairlead needs to be replaced, where the fairlead surrounds the lines, ropes or cables, all of the lines, ropes or cables must be removed from the fairlead so that the fairlead can be removed for replacement. This can be a very time consuming and labor intensive service repair. Furthermore, removal of the lines, ropes or cables may expose the equipment to damage. What is needed is a fairlead assembly that can be easily removed and replaced without removing the lines, ropes or cables to provide access for maintenance.

SUMMARY

In various embodiments, a fairlead is disclosed that is comprised of at least two separable parts which can be installed with the lines, ropes or cables in the hoist. In one embodiment, a fairlead comprised of two pieces is disclosed. The two pieces are separable and are designed to be installed on a support member that may be further coupled to the housing of a hoisting device. The two fairlead pieces may be mating pieces. In one embodiment the piece may be identical. The two mating pieces may be mounted to a hoist fairlead support member and secured to captivate a wire or cable of a hoisting device.

In one embodiment, one mating piece is designed to fit to a "U" fairlead mount. When a second U-shaped piece is mated together with the first, the two U-shaped areas form an enclosed area that allows movement of a restrained cable or wire. One or more holes may be provided to allow for bolts or other fasteners to secure the two mating pieces.

Such a fairlead improves the serviceability of the equipment and reduces down time for replacement of a worn fairlead. Further embodiments provide added features such as a self locking capability and indication of degree of wear and are further described below.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the present disclosure is not limited to the specific methods and instrumentalities disclosed. In the drawings.

DETAILED DESCRIPTION

Figure 1:
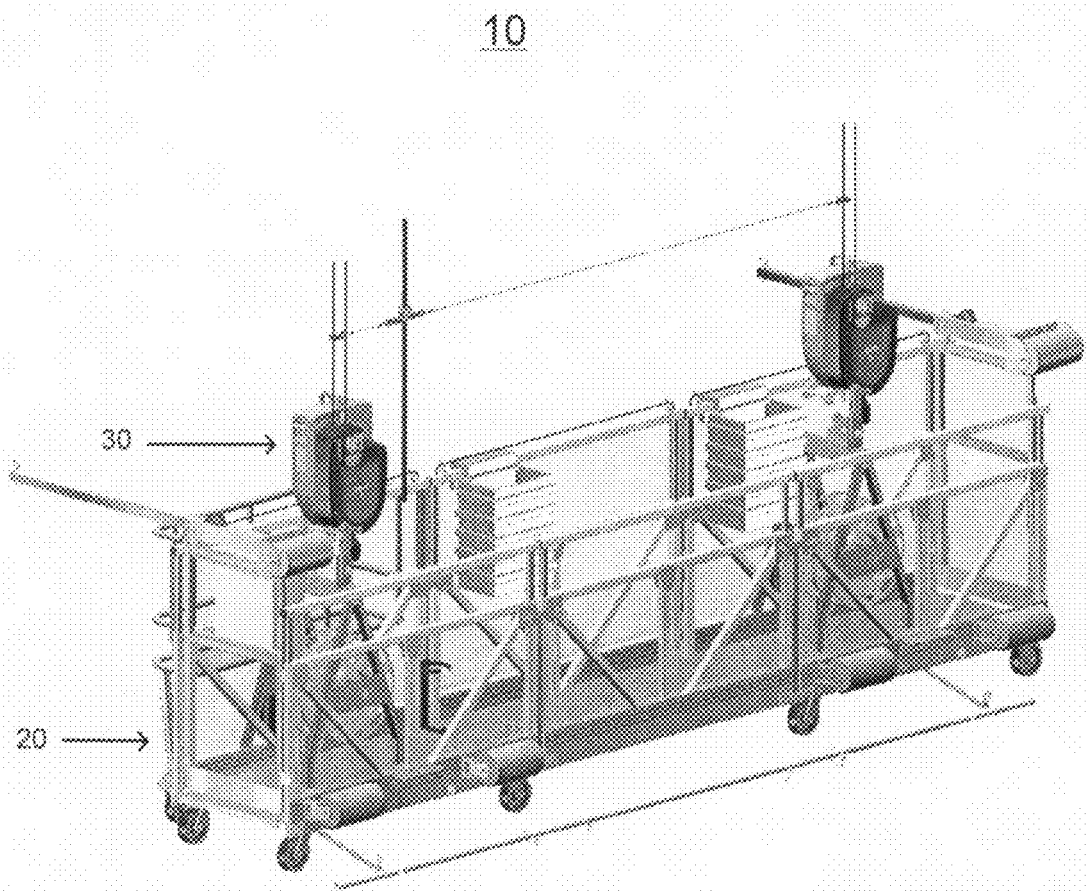
FIG. 1 is a diagram illustrating an example apparatus in which aspects of the described embodiments may be incorporated.

It is to be understood that the embodiments disclosed herein are not limited in application to the details of construction and the arrangement of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting.

The present disclosure relates to the production and service of hoisting devices used to elevate platforms or baskets typically associated with large structure service and maintenance, such at buildings, bridges, towers, and so on. In particular, the disclosure relates to a restraint device forming the fairlead of a platform or basket, in combination with a hoisting device. FIG. 1 depicts an exemplary platform apparatus 10 for supporting at least one person. As shown in the figure, a platform 20 can be a flat surface, scaffolding, basket or cabin. The platform is of sufficient size to carry at least one worker. In some embodiments, the platform 20 can support a plurality of workers. The platform is typically coupled to at least one powered hoisting device 30 such that the platform can be elevated or lowered in the vertical dimension. The platform may be further secured with safety lines and guidelines. When maintaining or constructing structures of various kinds, a platform apparatus of this kind provides transport of personnel and materials to and from the various landings of the structure. The platform apparatus may also be used for work on various elevated areas of the structure.

Figure 2:
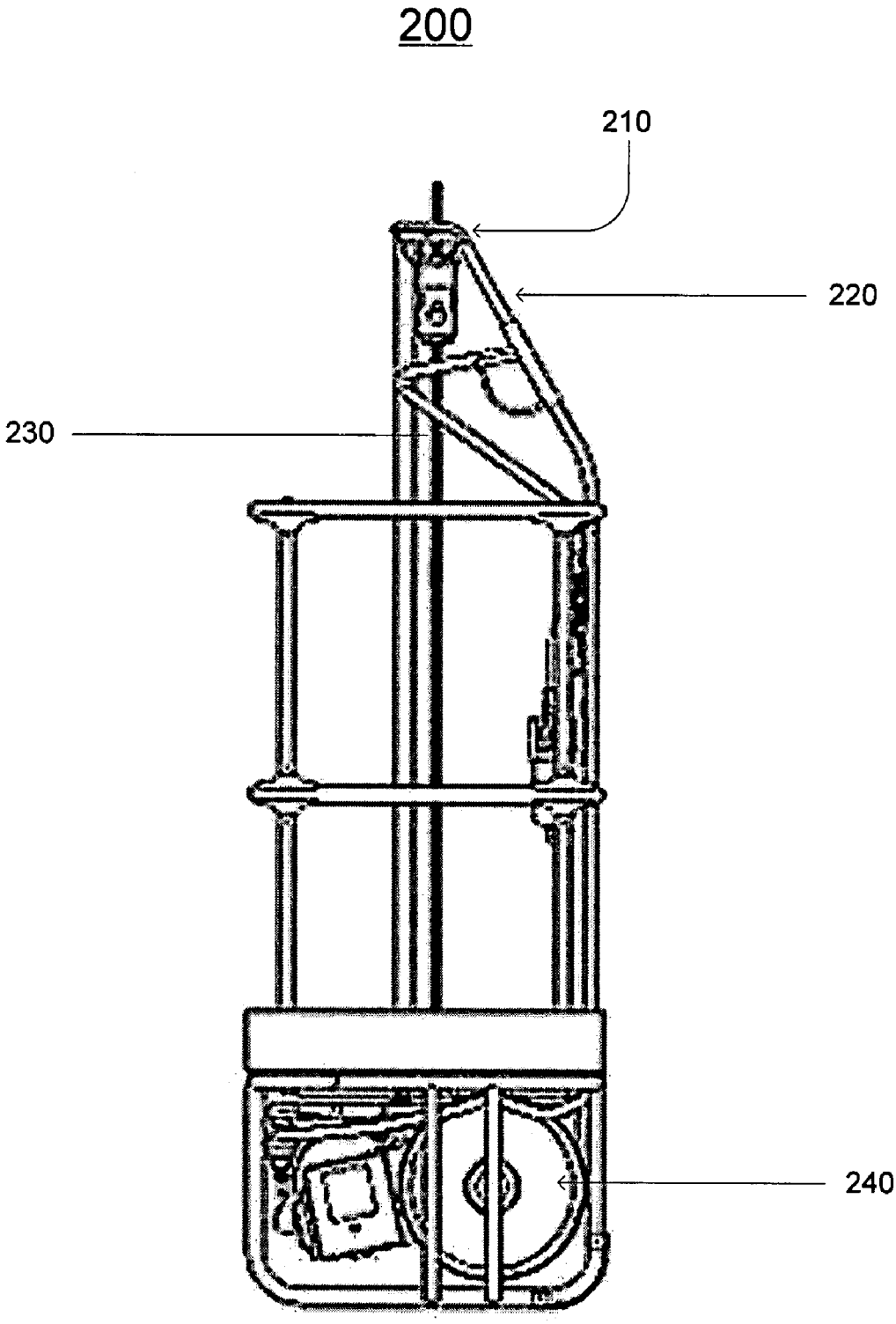
FIG. 2 is a diagram illustrating an embodiment of a hoisting device.

FIG. 2 depicts an exemplary hoisting device 200 that may be used to elevate a platform or basket. A motor assembly 240 provides vertical lift control to the platform by winding cable 230 around a spool or drum. Cable 230 may be securely attached to the top of the structure to be traversed. Cable 230 is further guided at the top of the hoisting device by a restraint assembly 210. Such a restraint assembly guides the line or cable from the spool or drum to the top of the platform by preventing the line or cable from moving laterally and otherwise prevent the line or cable from snagging. The restraint assembly also prevents the line or cable from vibrating or rubbing on other surfaces. The line or cable can be any type of line of sufficient strength and flexibility, such as a rope, chain, or metallic cable.

The restraint device comprises a fairlead, which is a member such as a ring or a block that has a guide opening. Such fairleads are typically a single piece that entirely surrounds the cable or rope. Thus a fairlead is normally installed during the downtime of a platform or hoisting device such that the end of the line or cable can be fed through the opening of the fairlead.

Fairleads typically wear or may otherwise be damaged over time as the lines or cables continuously move across the inside edges of the fairlead as the platform is raised or lowered during normal use. As can be seen from FIG. 2, a fairlead has an opening for the line or cable that encloses the circumference of the line or cable in order to secure the line or cable from lateral movement. However, the line or cable feeds through the opening of the fairlead. The end of the line or cable typically wraps around a spool. A typical replacement or repair of the fairlead requires that the line or cable be unwound from the hoisting device's spool in order to remove the fairlead and install a replacement. Other configurations are possible that use a configuration other than a spool but similar problems with fairlead replacement may be present.

Figure 3:
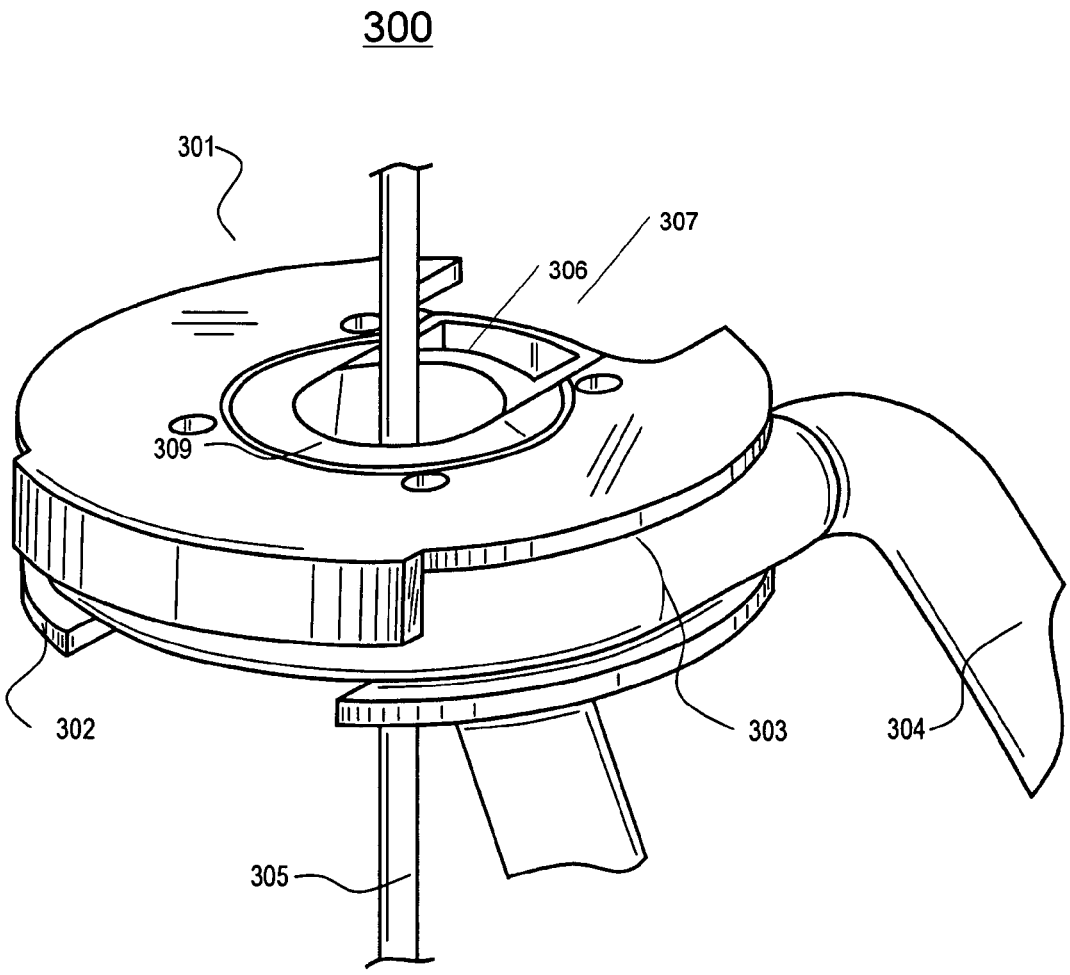
FIG. 3 is a diagram illustrating an embodiment of a fairlead mounted on a hoist fairlead support bracket.

In one embodiment of an aspect of the present disclosure, FIG. 3 depicts a restraint assembly 300 that is comprised of a fairlead consisting of two pieces 301 and 302. The two pieces are separable and are designed to be installed on a support member 304 that may be further coupled to the housing of a hoisting device. The restraint assembly 300 operates to restrain movement of a cable or wire 305 passing through an opening 306 of the restraint assembly. The cable or wire may be any type of rigging operable to elevate or lower a platform to be controlled by the hoisting device, and is typically a wire, rope or cable. Furthermore, the fairlead may comprise more than two pieces and may consist of dimensions other than that shown in the figure. Support member 304 is an exemplary embodiment, and may differ according to the type of hoisting device or platform used in the particular application. For example, in some cases a fairlead may be comprised of three separable pieces to enable secure mating to the support member.

In one embodiment, the fairlead pieces can be substantially identical mating pieces. As shown in FIG. 3, the location, captivation and orientation at the fairlead support is provided when the two halves are mated as indicated. The two identical mating pieces 301 and 302 may be mounted to a hoist fairlead support member 304 and secured to captivate the wire or cable 305. The first half 302 is mounted under the fairlead support 303, and the second half 301 is conceptually inverted and rotated 180 degrees with respect to the other piece to mate to the first half and form the complete fairlead mounted on the fairlead support member 304.

Also shown in FIG. 3 is an inner rim 307 on separable piece 302 that operates to substantially enclose the opening 306 when mated and form the fairlead hole through which the wire or cable 305 can freely move. An aspect of providing the fairlead pieces as identical mating pieces is that only one part type is required to provide the two piece assembly. Thus only one part needs to be fabricated and kept in inventory, reducing the costs associated with maintaining the fairlead.

As explained above, fairlead pieces 301 and 302 which form part of the restraint assembly 300 are separable and thus can be removed without pulling the cable or wire through the fairlead opening. Replacement of either or both pieces thus may be performed in-situ, including when the platform is under load.

The ability to replace the fairlead in-situ enables a hoisted platform apparatus that incorporates such a fairlead to be maintained and repaired more quickly and efficiently. One aspect is the reduction of down time for service. A typical fairlead device without the capability to be separated can take a minimum of 45 minutes to replace during routine service. Referring back to FIG. 2, it can be seen that in order to replace the fairlead at location 210 that surrounds the cable or wire 230, the hoist device 200 and the attached platform 10 must typically be lowered to a resting position so that the cable or wire 230 can be disengaged from the hoisting device, allowing for the cable or wire to be unwound and the fairlead removed.

The separable fairlead assembly depicted in FIG. 3 can be separated and removed without the need for disengaging the cable or wire, and can even be removed and replaced when the platform is under load. Since each fairlead piece does not completely enclose the cable or wire, removal of the fairlead only requires separation from one another and the support member. Likewise, installation of a replacement fairlead simply requires the insertion of each piece around the cable or line, and mating and securing the pieces to one another and/or the support member.

A further feature of the embodiment described above is that a fairlead assembly comprised of two simple components as illustrated provides for ease of manufacturability and reduction of manufacturing and maintenance costs. For example, in the case of a fairlead comprised of a single piece, the fairlead must be designed and fabricated to fit the fairlead support member 304, provide securing means to the support member, and provide an opening 401 for the wire or cable 305. The design of such a device as a single assembly is typically more complex and thus more costly than fabricating a mating piece 301 such as that shown in FIG. 3.

Figure 4:
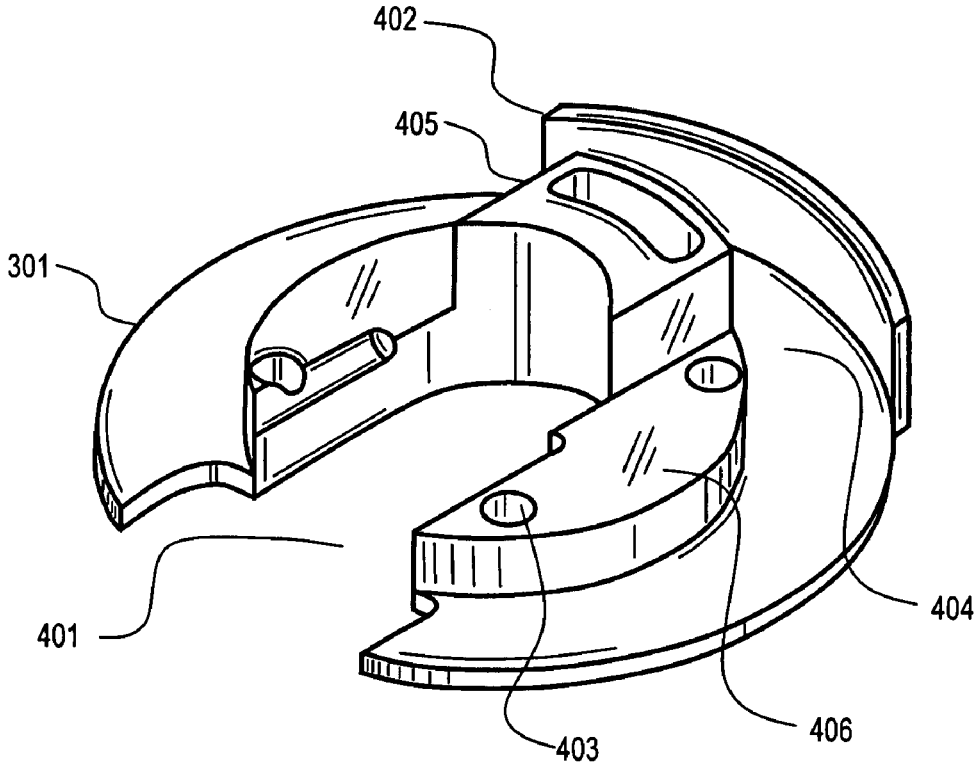
FIG. 4 is a diagram illustrating an embodiment of a fairlead disclosed herein.

FIG. 4 further provides a more detailed illustration of the fairlead piece 301 designed to fit to a "U" shaped fairlead mount. As shown, the piece 301 includes a U-shaped opening 401. When a second piece 301 is conceptually inverted and turned 180 degrees with respect to the other piece such that the two U-shaped areas are mated together, the two U-shaped areas 401 form an enclosed area that allows movement of a restrained cable or wire. In other embodiments, the "U" shaped area may be of differing dimensions to accommodate cables or wires of various diameters or to accommodate a plurality of wires and cables. Additionally, the open area 401 may be provided with other shapes provided that the mated pieces fully enclose the open area 401. The apparatus described herein may be embodied to operate in conjunction with a variety of rigging and platform configurations, and the various embodiments described herein should not be seen as being limited to a particular example. Rigging systems may consist of cables of various diameters or may consist of a plurality of cables operating through a single fairlead. Furthermore, the support member 304 may vary in size and structure depending on the type of hoist device and platform used. In other embodiments a support member may not be provided and the fairlead may be attached directly to a hoist device or rigging or through other means.

Returning to FIG. 4, the mating piece 301 is shown with bolt holes 403. Any number of holes may be provided to allow for bolts or other fasteners to secure the two pieces. However only a minimum of one bolt or fastener is typically required to keep the two pieces from separating. Referring to FIG. 3, support member 304 connects the fairlead support to the platform or basket. The bolt holes may be located such that the two mated fairlead pieces can be fastened together without penetrating the support member. When the fairlead assembly is mounted on the fairlead support as illustrated, penetration of the fairlead support for attachment is not required, thereby preserving the maximum strength of the fairlead support. In further embodiments, additional bolt or fastener holes may be provided to attach an optional tension holder.

Returning to FIG. 4, the mating piece 301 further comprises sleeve area 404 that fits onto a fairlead support member 304 as depicted in FIG. 3. The support rim 402 secures the fairlead assembly against the U-shaped portion 303 of the fairlead support member. Sleeve area 404 and support plate 402 can be shaped to fit mounting members of various designs and arrangements. For example, the support member may comprise a straight rather than a curved mounting area, in which case the sleeve area and support plate can comprise straight rather than curved features.

Support rim 402 is perpendicular to the surface of the separable piece and generally follows the curved outer edge. Support rim 402 operates to mate with support member 304 or curved portion 303 of the support member 304 when the two separable pieces are inverted and mated with one another. Inner column 405 is also perpendicular to the surface of the separable piece 301 and generally follows the curved outer edge of the U-shaped gap. The column 405 operates to enclose the opening area 401 on the second separable part, thus forming a generally circular opening through which a rigging can freely pass. Elevated columns 406 provide additional structural support for fitting the separable piece to the curved portion 303 of the support member 304.

In an alternative embodiment, the fairlead mating pieces 301 and 302 can be self-locking and thus not require bolts or other fasteners. For example, self-locking elements can be bonded to the areas of contact between the mating pieces or to the support member 304. Alternatively, self-locking fastener elements can be included in place of bolt or fastener holes, thus eliminating the need for additional bolts.

FIG. 3 further depicts an indication of degree of wear guide 309. During normal operation of the platform the movement of the cables and wires will typically cause long term wear on the inner edges of the fairlead opening 306. Such indicators may be provided to indicate the maximum degree of wear beyond which a replacement is required or recommended. The indicators may be imprinted and integral to structure of the separable part 301, or can be marked using various marking methods such as ink or paint. Other types or shapes of wear indication guides may be provided to match various fairlead designs and the expected wear patterns on the fairlead.

Figure 5:
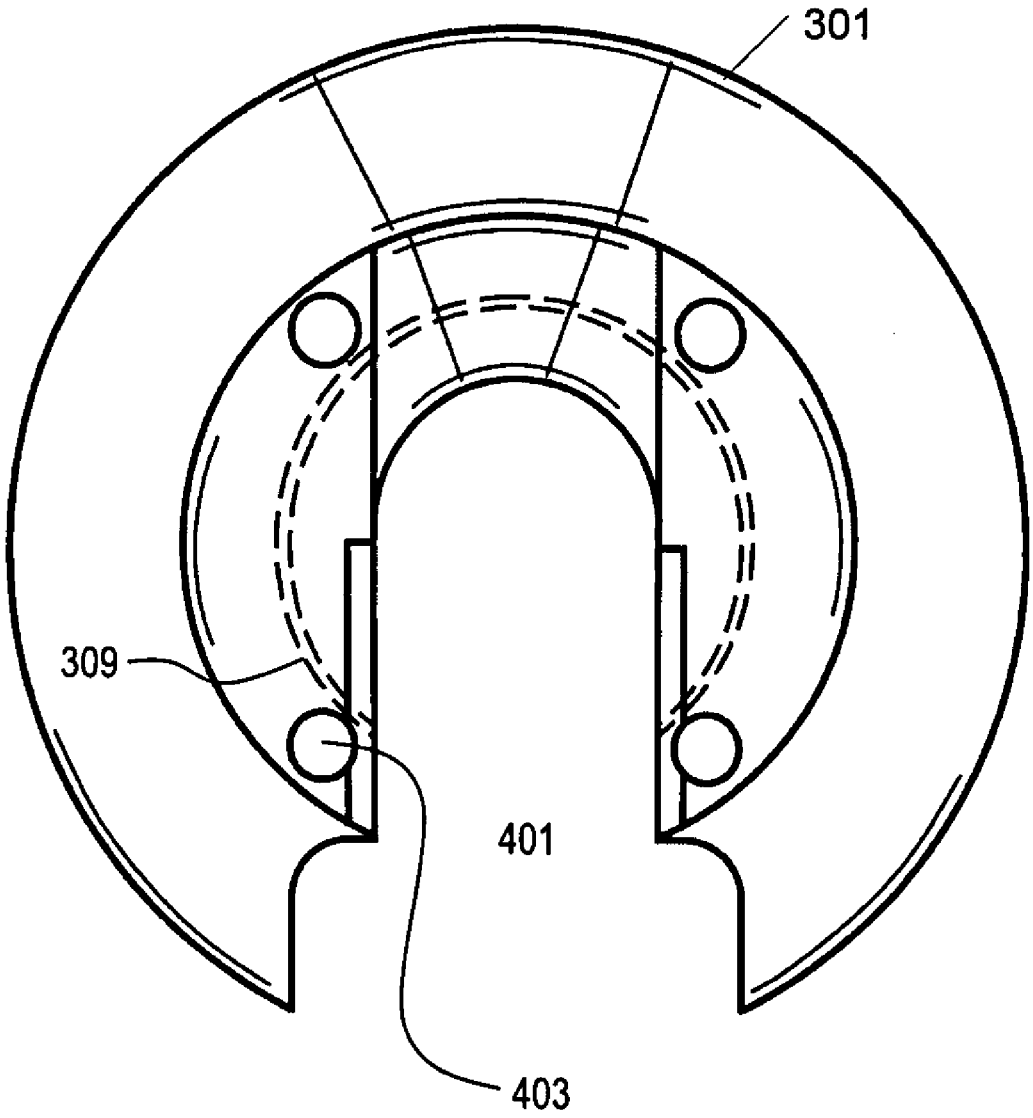
FIG. 5 is a diagram illustrating a further view of an embodiment of a fairlead disclosed herein.

FIG. 5 depicts a top-down view of a fairlead mating piece 301. Shown are various aspects of the mating piece as described above, including fastening holes 403, wear indicator 309, and open area 401. As illustrated the fastening holes may be equally spaced along the inner circumference of the separable piece. However, the number and placement of the fastening holes 403 may vary without departing from the scope of this disclosure. Similarly, the wear indicator 309 may be varied to match the size and shape of the open area 401.

The various embodiments of the fairlead may be composed of appropriate materials that provide durability, resilience, abrasion resistance and strength. For example, thermoplastic polymers such as nylon and its various embodiments such as Nylatron may be used and can be fabricated using a single injection mold. In other embodiments other types of polymers can be used. However, the materials that may be used to fabricate the disclosure described herein are not limited to polymers. The present disclosure contemplates the use of various materials such as metal, plastic, or wood as may be useful for various applications and embodiments.

The method of use of embodiments of the present disclosure will now be discussed. As described above, fairleads typically wear or may otherwise be damaged over time as the lines or cables continuously move across the inside edges of the fairlead as the platform or basket is raised or lowered during normal use. Referring to the embodiment shown in FIG. 2, a fairlead has an opening for the line or cable that encloses the circumference of the line or cable in order to secure the line or cable from lateral movement. The line or cable feeds through the opening of the fairlead. The end of the line or cable typically wraps around a spool.

In the embodiment depicted in FIG. 3, the restraint assembly 300 is comprised of a fairlead consisting of two pieces 301 and 302. In one embodiment, the fairlead pieces are substantially identical mating pieces. As shown in FIG. 3, the two mating pieces 301 and 302 may be mounted to a hoist fairlead support member 304 and secured to captivate the wire or cable 305. The first half 302 is mounted under the fairlead support 303, and the second half 301 is conceptually inverted and rotated 180 degrees with respect to the other piece to mate to the first half and form the complete fairlead mounted on the fairlead support member 304.

When the fairlead requires removal, fairlead pieces 301 and 302 are separated by removing any fastening mechanisms and pulled apart. The fairlead pieces can then be removed without unwinding the cable or wire by pulling each fairlead piece through their respective opening 401 depicted in FIG. 4. Since each fairlead piece does not completely enclose the cable or wire, removal of the fairlead only requires separation from one another and the support member. Replacement of either or both pieces thus may be performed in-situ, including when the platform is under load. Referring to FIG. 3, the hoist device 200 and the attached platform 10 can be left in place and not be lowered to a resting position. The cable or wire 230 can be left in place in the hoisting device.

To install a replacement fairlead, two new fairlead pieces 301 and 302 can be placed around the cable or line, mated to one another and secured to one another and/or the support member.

Referring to FIG. 4, which depicts a more detailed illustration of the fairlead piece 301 designed to fit to a "U" shaped fairlead mount, a method for removing and replacing such a fairlead is described. As shown, the piece 301 includes a U-shaped opening 401. To install the U-shaped fairlead, a first piece 301 is conceptually inverted and turned 180 degrees with respect to a second piece 302 such that the two U-shaped areas are mated together and the two U-shaped areas 401 form an enclosed area that allows movement of a restrained cable or wire.

As described above, in various embodiments the "U" shaped area may be of differing dimensions to accommodate cables or wires of various diameters or to accommodate a plurality of wires and cables. Additionally, the open area 401 may be provided with other shapes provided that the mated pieces fully enclose the open area 401. The methods described herein may be embodied to operate in conjunction with a variety of rigging and platform configurations, and the various embodiments described herein should not be seen as being limited to a particular example. Rigging systems may consist of cables of various diameters or may consist of a plurality of cables operating through a single fairlead. Furthermore, the support member 304 may vary in size and structure depending on the type of hoist device and platform used. In other embodiments a support member may not be provided and the fairlead may be attached directly to a hoist device or rigging or through other means.

Returning to FIG. 4, the mating piece 301 is shown with bolt holes 403. Any number of holes may be provided to allow for bolts or other fasteners to secure the two pieces. However only a minimum of one bolt or fastener is typically required to keep the two pieces from separating. When removing a fairlead assembly for repair or replacement, the bolt or fastener is removed to enable the unmating and removal of the fairlead pieces 301 and 302. In an embodiment whereby the fairlead mating pieces 301 and 302 are self-locking, removal of bolts or other fasteners may not be required.

It will be understood that each of the elements described above, or two or more together may also find a useful application in other types of methods differing from the type described above. Although the more detailed examples provided above relate to elevated platforms for building maintenance, it should be apparent to one of ordinary skill in the art that the apparatus and methods described herein will find application to other systems that utilize fairlead mechanisms. Additionally, the foregoing description has set forth various embodiments of the apparatus and methods via the use of diagrams and examples. While the present disclosure has been described in connection with the preferred embodiments of the various figures, it is to be understood that other similar embodiments may be used or modifications and additions may be made to the described embodiment for performing the same function of the present disclosure without deviating there from. Furthermore, it should be emphasized that a variety of applications, including marine and transportation systems, are herein contemplated. Therefore, the present disclosure should not be limited to any single embodiment, but rather construed in breadth and scope in accordance with the appended claims. Additional features of this disclosure are set forth in the following claims.

What is claimed:

1. An apparatus comprising:

a platform;

a hoisting machine mounted on the platform;

a rigging operable to raise and lower the platform, said rigging further comprising a cable passing through a fairlead, said fairlead stabilizing said platform to a single location proximate a top of said platform, said fairlead comprising at least two separable parts wherein said each separable part further comprises fastening means and a radial gap on one side of said separable part.

2. The apparatus of claim 1, wherein said rigging comprises one of at least wire, cable, chain or rope.

3. The apparatus of claim 1, wherein said platform comprises one of a scaffolding, basket, or cabin.

4. The apparatus of claim 1, wherein said separable parts are comprised of at least one of a polymer, plastic, wood, or nylon.

5. The apparatus of claim 1, wherein said separable parts are interlocking.

6. The apparatus of claim 5, wherein said separable parts are substantially identical mating pieces.

7. The apparatus of claim 6, wherein said separable parts are self locking.

8. The apparatus of claim 1, wherein said separable part further comprises an indication of a degree of wear.

9. The apparatus of claim 1, wherein a first separable part is designed to be mounted under a fairlead support member and a second separable part is designed to mate to said first separable part by inverting said second separable part with respect to said first separable part other piece and rotating 180 degrees with respect to said first separable part.

10. The apparatus of claim 9, wherein said separable part is designed to fit to a U-shaped fairlead mount.

11. The apparatus of claim 10, wherein said separable part is generally circular, said gap is U-shaped with the curved area located co-centrically with said separable part, further comprising: an outer rim for mating with said fairlead mount; and an inner rim generally co-centric with said fairlead mount and forming a substantially enclosed coaxial opening when said first separable part is mated with said second separable part.

12. The apparatus of claim 1, wherein said separable part further comprises at least one hole for mounting and locking.

13. The fairlead of claim 12, wherein said fairlead further comprises an indication of a degree of wear.

14. The fairlead of claim 12, wherein a first separable part is designed to be mounted under a fairlead support member and a second separable part is designed to mate to said first separable part by inverting said second separable part with respect to said first separable part other piece and rotating 180 degrees with respect to said first separable part.

15. The fairlead of claim 14, wherein said fairlead is designed fit to a U-shaped fairlead mount.

16. The fairlead of claim 15, wherein said separable part is generally circular, said gap is U-shaped with the curved area located co-centrically with said separable part, further comprising: an outer rim for mating with said fairlead mount; and an inner rim generally co-centric with said fairlead mount and forming a substantially enclosed coaxial opening when said first separable part is mated with said second separable part.

17. The fairlead of claim 12, wherein said separable part further comprises at least one hole for mounting and locking.

18. A fairlead for guiding and securing a rigging used with a hoisting device in an elevator platform, said fairlead comprising at least two separable parts wherein said each separable part further comprises fastening means and a radial gap on one side of said separable part.

19. The fairlead of claim 18, wherein said fairlead is comprised of nylon.

20. The fairlead of claim 18, wherein said fairlead is interlocking.

21. The fairlead of claim 20, wherein said separable interlocking parts are identical mating pieces.

22. The fairlead of claim 21, wherein said separable interlocking parts are self locking.

23. An apparatus for restraining rigging movement on an elevator platform for building maintenance, said elevator platform having a hoisting machine coupled to a rigging, said rigging passing through a fairlead, said fair lead stabilizing said elevator platform to a single location proximate a top of said elevator platform, said fairlead comprising at least two separable parts wherein said each separable part further comprises fastening means and a radial gap on one side of said separable part.

24. The apparatus of claim 23, wherein said rigging comprises one of at least wire, cable, chain or rope.

25. The apparatus of claim 23, wherein said elevator platform comprises one of a scaffolding, basket, or cabin.

26. The apparatus of claim 23, wherein said fairlead is comprised of nylon.

27. The apparatus of claim 23, wherein said fairlead is interlocking.

28. The apparatus of claim 27, wherein said separable interlocking parts are identical mating pieces.

29. The apparatus of claim 28, wherein said separable interlocking parts are self locking.

30. The apparatus of claim 23, wherein said fairlead further comprises an indication of a degree of wear.

31. The apparatus of claim 23, wherein a first separable part is designed to be mounted under a fairlead support member and a second separable part is designed to mate to said first separable part by inverting said second separable part with respect to said first separable part other piece and rotating 180 degrees with respect to said first separable part.

32. The apparatus of claim 31, wherein said fairlead is designed fit to a U-shaped fairlead mount.

33. The apparatus of claim 32, wherein said separable part is generally circular, said gap is U-shaped with the curved area located co-centrically with said separable part, further comprising: an outer rim for mating with said fairlead mount; and an inner rim generally co-centric with said fairlead mount and forming a substantially enclosed coaxial opening when said first separable part is mated with said second separable part.

34. The apparatus of claim 23, wherein said separable part further comprises at least one hole for mounting and locking.

35. A method for replacing a fairlead used in an apparatus comprising a platform, a hoisting machine mounted on the platform, and a rigging operable to raise and lower the platform, said rigging passing through a fairlead, said fair lead stabilizing said platform to a single location proximate a top of said platform, said fairlead comprising at least two separable parts wherein said each separable part further comprises fastening means and a radial gap on one side of said separable part, the method comprising separating and removing a first pair of separable parts without accessing an end of said rigging, and installing a second pair of separable parts around said rigging without accessing an end of said rigging.

36. The method of claim 35, wherein a first separable part is designed to be mounted under a fairlead support member and a second separable part is designed to mate to said first separable part by inverting said second separable part with respect to said first separable part other piece and rotating 180 degrees with respect to said first separable part.

37. A method for replacing a fairlead used for guiding and securing a rigging used with a hoisting device in an elevator platform, said fairlead comprising at least two separable parts wherein said each separable part further comprises fastening means and a radial gap on one side of said separable part, the method comprising separating and removing a first pair of separable parts without accessing an end of said rigging, and installing a second pair of separable parts around said rigging without accessing an end of said rigging.

38. The method of claim 37, wherein said first separable part is mounted under a fairlead support member and said second separable part is inverted and rotated 180 degrees to mate to said first separable part.

* * * * *

UNITED STATES PATENT AND TRADEMARK OFFICE

CERTIFICATE OF CORRECTION

PATENT NO. : 7,475,867 B1
APPLICATION NO. : 11/851975
DATED : January 13, 2009
INVENTOR(S) : David Arevalo Romo It is certified that error appears in the above-identified patent and that said Letters Patent is hereby corrected as shown below:

Column 8, line 6 (Claim 13) should read;
13. The fairlead of claim 18, wherein said fairlead further comprises an indication of a degree of wear.

Column 8, line 8 (Claim 14) should read;
14. The fairlead of claim 18, wherein a first separable part is designed to be mounted under a fairlead support member and a second separable part is designed to mate to said first separable part by inverting said second separable part with respect to said first separable part other piece and rotating 180 degrees with respect to said first separable part.

Column 8, line 6 (Claim 17) should read;
17. The fairlead of claim 18, wherein said separable part further comprises at least one hole for mounting and locking.

Signed and Sealed this

Twenty-first Day of July, 2009

John Doll

JOHN DOLL
*Acting Director of the United States Patent and Trademark Office*